US007021230B1

(12) United States Patent
Lawrence

(10) Patent No.: US 7,021,230 B1
(45) Date of Patent: Apr. 4, 2006

(54) FLOATABLE DOCK MOORING ARTICLE

(76) Inventor: Gary L. Lawrence, 8036 Bricker Rd., NW., Massillon, OH (US) 44646

( * ) Notice: Subject to any disclaimer, the term of this patent is extended or adjusted under 35 U.S.C. 154(b) by 0 days.

(21) Appl. No.: 10/953,154

(22) Filed: Sep. 29, 2004

(51) Int. Cl.
*B63B 22/02* (2006.01)

(52) U.S. Cl. ..... 114/230.13; 441/3

(58) Field of Classification Search ..... 114/230.1, 114/230.11–230.18, 230.27, 230.28; 441/3
See application file for complete search history.

(56) References Cited

U.S. PATENT DOCUMENTS 3,001,371 A 9/1961 Gilmore, Jr. et al.
3,430,598 A * 3/1969 Soderberg ..... 114/230.27
3,486,342 A 12/1969 Aks
RE27,050 E 2/1971 Jorgenson
3,842,779 A * 10/1974 Jaynes ..... 114/230.24
4,480,576 A 11/1984 Mills
5,050,521 A 9/1991 Stone
5,301,628 A 4/1994 Daskalides
5,467,727 A 11/1995 Godvin et al.
5,937,781 A 8/1999 Isella et al.
6,123,045 A 9/2000 Prongay

* cited by examiner

*Primary Examiner*—Jesus D. Sotelo
(74) *Attorney, Agent, or Firm*—Hudak, Shunk & Farine Co., LPA

(57) ABSTRACT

A floating dock mooring article, which slidably fits around a watercraft dock pipe, comprising a flotation device attached to a mooring member and a flange generally located at the upper end thereof. A watercraft is moored to the dock, as by a rope, via the flotation mooring article. When the water level rises as due to a flood, the float will cause the mooring article to raise-up the dock pipe and maintain securement of the watercraft to the dock.

13 Claims, 2 Drawing Sheets

FLOATABLE DOCK MOORING ARTICLE

BACKGROUND OF THE INVENTION

Heretofore, watercrafts such as boats, canoes, jet skis, rafts etc. have generally been moored to a dock pipe as by a rope. If tightly bound, the rope would prevent the watercraft from rising as the water level rises, thus causing the watercraft to tip and possibly sink. Alternatively, if the rope was loosely bound, the rope would rise with increasing water height and come off the dock pipe causing the watercraft to drift away and even be lost.

Prior art mooring devices are set forth in the following U.S. Patents:

U.S. Pat. No. Re 27,050 relates to a reportedly force absorbing system adapted to be used with a moored vessel including a base affixed to the dock, a pair of yielding elements extending from the base and a pair of vertically disposed bumper sections attached to respective yielding elements. The bumper sections are suspended in the water with clearance from the bottom and receive support from the dock from above the water line.

U.S. Pat. No. 3,001,371 relates to an offshore drilling rig mooring and more particularly to a floating mooring buoy especially adapted for a floating attachment to an offshore drilling rig support.

U.S. Pat. No. 3,486,342 relates to a mooring bumper device having a floatable base floating on a water surface and loosely surrounding a mooring pile for up and down movement thereon under the action of tide and wind. The bumper device has an axial opening through which the mooring pile extends and the upper terminal end of the bumper device is flat and horizontal. A metal hitch ring provided with a plurality of eyes to one or more of which a boat mooring line is attached is freely seated on the flat upper end of the bumper device in surrounding relation to the mooring pile providing relative rotation between the bumper device and the hitch ring. The eyes on the hitch ring lie inwardly of the peripheral edge of the flat upper end of the bumper device.

U.S. Pat. No. 4,480,576 relates to a boat mooring arrangement which reportedly permits the boat to rise and drop vertically with tides or wave action, but which constrains the boat from lateral movement relative to a fixed dock or pier. A pair of cylindrical posts are affixed to the dock or pier at spaced-apart locations and extend vertically downward therefrom for a predetermined distance below the surface of the water. Associated with each of these posts is a carriage assembly comprising a U-shaped collar having rollers journaled for rotation across the spaced-apart legs of the U-shaped collar. The carriage assemblies reportedly cooperate with the exterior surface of the posts and ride up and down with respect to the posts when the carriage assemblies are fastened to the boat to be moored by suitable tie lines and changes in water level are encountered.

U.S. Pat. No. 5,050,521 relates to a boat mooring apparatus to allow for ease of travel up and down dock piling posts in such a fashion that it is free to move vertically with changes in tide. It comprises a mooring line roller and chafe resistor which includes a ribbed tube and spools or rollers mounted on tube and fitted over the mooring lines. It is fitted on the dock lines and around the dock posts and tied to the cleats of a vessel to be moored.

U.S. Pat. No. 5,301,628 relates to a docking post which includes a tubular housing having a front wall, including an elongate slot directed through the front wall longitudinally aligned relative the housing and parallel to the housing axis, with the housing having a rear wall mounted to an associated mooring post. A first tube is mounted within the housing, having a securement ring thereon, with a second tube positioned below the first tube having a length adjusted to accommodate a predetermined length between a boat water line and a boat securement cleat. A third buoyant tube is mounted below the second tube to effect displacement of the first and second tube to reportedly effect displacement of the first and second tube relative to rising and lowering tides and water level relative to the tubular housing.

U.S. Pat. No. 5,467,727 relates to a hollow toroidal member of high-strength material for reportedly withstanding mooring loads and has a central opening which slips over a mooring pile. A reinforcing ring is preferably secured in the core of the member to provide additional load-bearing capability to the device. A pair of diametrically opposite mooring openings are formed in the member and ring each opening for receiving a boat mooring line, the openings in the member and ring being aligned. The member is preferably molded with its core in fluid isolation from the ambient atmosphere to provide buoyancy. In the alternative, the core is filled with flotation material. A pair of apertured legs may be used in place of the openings in the member for securing the mooring lines thereto.

U.S. Pat. No. 5,937,781 relates to a watercraft mooring device which reportedly permits the watercraft to rise and drop vertically with the water level and which provides both direct shock absorption between the watercraft and the fixed mooring point, such as the pier or piling, and protection against scraping between the watercraft and the fixed mooring point. A floating tube is provided, which is designed to loosely fit over and around the fixed mooring point and which provides one or more attachment grooves for holding an attachment rope, cord or cable in place. The provided floating tube includes one or more securing hooks for securing the attachment rope, cord or cable when it is not needed to moor the watercraft. By providing a floating mooring device, the watercraft is permitted to maintain the same relative distance between the watercraft and the fixed mooring point, providing a device for protecting a watercraft from undesirable contact with other mooring structures.

U.S. Pat. No. 6,123,045 relates to a device for dock storage and boat accessible retrieval of a boat docking line. The device generally comprises a pedestal that is fixedly attachable to a dock and an arm rotatably attached to the upper end of said pedestal, said arm including a hook disposed at the distal end of said arm for receipt of a docking line.

SUMMARY OF THE INVENTION

A floatable dock mooring article comprises a mooring member having a flange at the upper portion thereof and a floatation device located beneath the flange. The dock mooring member, which slidably fits around a dock pipe, rises and falls with the level of the water thus allowing a watercraft such as a boat to rise and fall with the water level and not tip, sink or be released from the dock. A leg extending downward from the flotation device accommodates excessively high water levels.

DETAILED DESCRIPTION

Figure 1:
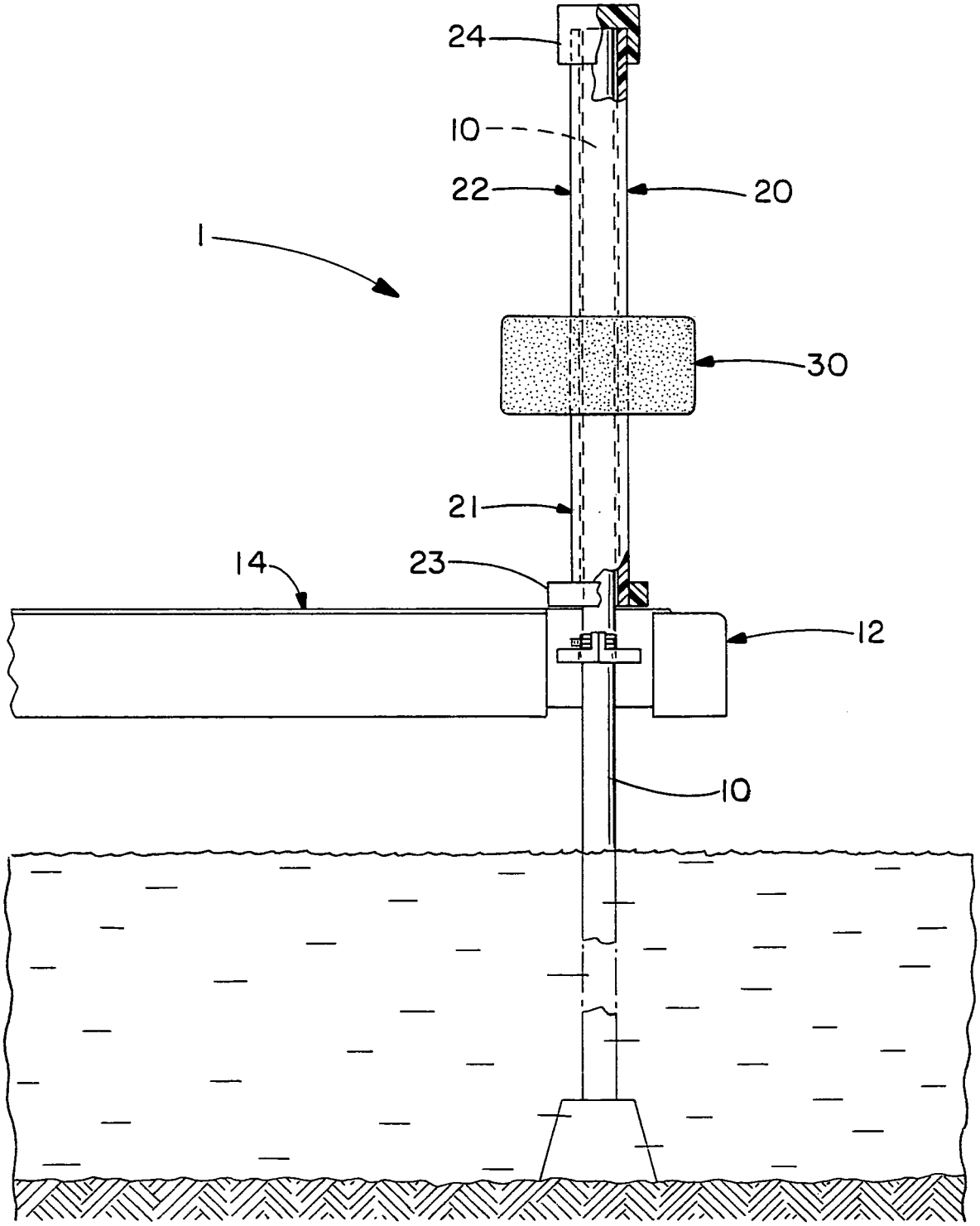
FIG. 1 is a side elevation view, in partial cross-section, of a floatable dock mooring article according to the present invention.

Referring to FIG. 1, a watercraft dock pipe 10 supports, in any conventional manner, dock 12 located above a body of water such as a lake, a river, a bay, etc. As shown in FIG. 1, a portion of dock pipe 10 generally extends a distance above the dock and mooring ropes, etc., have been connected thereto to retain a watercraft. Watercraft generally includes boats, canoes, jet skis, rafts, and the like.

Floating dock mooring article 1 is designed to be placed over and about dock pipe 10 which extends above dock 12. Mooring article 1 comprises various types of mooring members 20 such as pipes, tubes, ducts, and the like with the requirement that they are generally in the form of an annulus having an inside diameter and an outside diameter spaced apart therefrom. While the shape of the annulus is generally circular, it is to be understood that any shape can be utilized, such as elliptical, egg-shaped, pear-shaped, square tubing, and the like. Mooring member 20 can be made out of any suitable material such as lightweight metal, e.g. aluminum or titanium, but desirably has a specific gravity of less than 1.0. Suitable materials include various types of wood, plastic, fiberglass, composites, and the like with plastic generally being preferred. Plastics include polyvinyl chloride, polyester, polystyrene, nylon, various polyolefins such as polyethylene or polypropylene, and the like with polyvinyl chloride being preferred.

Mooring member 20 naturally has an inside diameter which is greater than the outside diameter of dock pipe 10 so mooring member 20 can easily be inserted thereover and freely rotate and/or elevate thereabout. Generally mooring member 20 has a lower flange 23 which contacts dock floor 14 and permits the member to rest thereon. Upper flange 24 is generally located at the upper vertical end portion of the pipe and preferably at the very end thereof. Flanges 23 and 24 can be attached, secured, etc. in any manner, as by screws, bolts, and more desirably is adhered by an adhesive such as styrene, epoxy, or acrylate and the like. The length of mooring member 20 can vary as from about a foot to any desired length such as about 10 or 12 feet with generally from about 2 to about 6 or about 8 feet desired. Naturally, the mooring member can be cut to any desirable length to compensate for a rise in the level of a body of water.

An important aspect of the present invention is the utilization of a flotation device 30 attached to mooring member 20 at any desired location. The float is made of a material which is lighter than and preferably substantially lighter than water and can be wood, plastic, foam, composite materials and the like. Float 30 can be rigid, semi-rigid, resilient or semi-resilient, or flexible. If the foam is made from a polymer, it can be closed-cell, or if an open cell structure preferably contains a continuous layer of a skin thereon to prevent water from entering. Suitable flotation devices 30 include various foams of polyurethane, polystyrene and the like. As with the flanges, flotation device 30 can be applied or secured to mooring member 20 in any conventional manner as through the use of flanges located on the top and bottom of the float and secured to the mooring member, but preferably is secured to the mooring member through the use of an adhesive such as styrene, epoxy, or acrylate, and the like.

Figure 3:
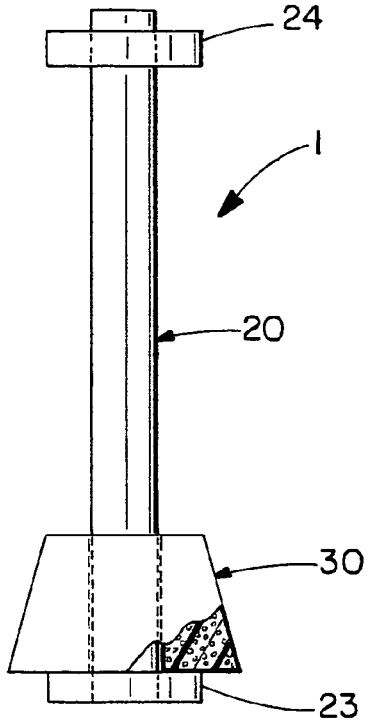
FIG. 3 is a partial side elevation view of another embodiment of the present invention showing only the floatable dock mooring article.

The shape of float 30 is generally not important so long as it has enough buoyancy so that when a rising water level of a lake, etc. contacts the float, it will raise up and cause mooring member 20 to float. While the float 30 is generally cylindrical as shown in FIG. 1, it can be in the form of a truncated frustum as shown in FIG. 3, wafer shaped, ball-shaped, and the like.

Figure 2:
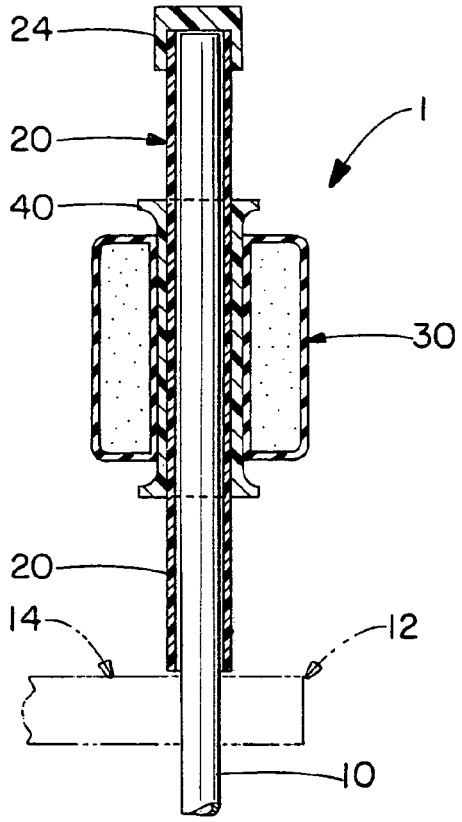
FIG. 2 is a side elevation view, in cross-section, of another floatable dock mooring article containing an inflatable float.

Another type of flotation device shown in FIG. 2 is an inflatable device made out of rubber or some other strong flexible material such as plastic and filled with a fluid, preferably air.

Regardless of the size, shape or type of flotation device, it can also generally serve as a bumper guard as to protect the side of a boat from striking a dock and being damaged.

The float 30 can generally be located in any position on mooring member 20 but desirably the bottom portion of the mooring member is avoided in order to prevent damage to the float by contact with the dock and also to allow a mooring device e.g., a rope to be attached thereto. Similarly, the float is not located at the top portion of the mooring member so when desired a mooring device can be attached thereto. Desirably, the float is located from about 10% to about 90% and more desirably from about 20% to about 80% of the mooring member height. Naturally the height of the float is generally small in comparison to the height of the dock mooring member 20 and is from about 1 or about 2 inches to about 6, about 8, or about 10 inches or even about one foot. Regardless of where the float is attached or adhered to mooring member 20, the portion below float 30 is referred to as lower leg 21 whereas the portion above the float is referred to as upper leg 22.

A mooring device such as a rope secures the watercraft to dock mooring member 20 which in turn freely rotates and/or elevates about dock pipe 10. In use, as the water level rises as in a flood, the water will generally contact float 30 and cause the mooring member to rise. Thus, the mooring device such as a rope will also rise and generally maintain an even relationship with the watercraft and thus does not cause it to tip and/or sink. If the rope is secured to upper leg 22, upper flange 24 prevents the rope from coming off the upper end of mooring member 20. Alternatively, if the rope is attached to lower leg 21, lower flange 23 will prevent the rope from being disengaged from mooring member 20. In order to gain an additional height advantage, float 30 is desirably located in an intermediate vertical portion of mooring member 20 or can be located near the top portion of a mooring member. The higher location provides an additional safety factor in that the water level must rise the additional distance to the upper float location before the pipe will commence rising up along dock pipe 10. For example, if flotation device 30 is located three feet above lower flange 23 or the bottom of mooring member 20, the water level must rise an additional three feet before it contacts flotation device 30 whereupon mooring member 20 commences rising. It should thus be apparent that floatable member article 1 of the present invention can accommodate large rises in the water level of a lake, river, etc.

Another embodiment of the invention relates to floatation device 30, which is not secured to mooring member 20, but rather freely slides up and down the mooring member. Such a floatation device can simply have an internal diameter which is larger than the external diameter of mooring member 20, but smaller than the outer diameter of flange 24 as in FIG. 3. Alternatively float 30 can be secured to sleeve 40 (see FIG. 2) preferably made out of light-weight material such as a composite or plastic as in the form a cylinder. While the entire outer portion of the sleeve could have the same radius, desirably the upper and lower portions of the sleeve have projections or flanges so that a rope, etc., can be secured thereabout. Since sleeve-floatation device 40 freely rotates and/or elevates about mooring member 20, it will normally reside on dock floor 14. However, upon a rising water level, the sleeve-flotation device will rise upwardly on dock pipe 10 until the top portion of the sleeve contacts upper flange 24 at which time mooring member 20 will commence rising.

Figure 4:
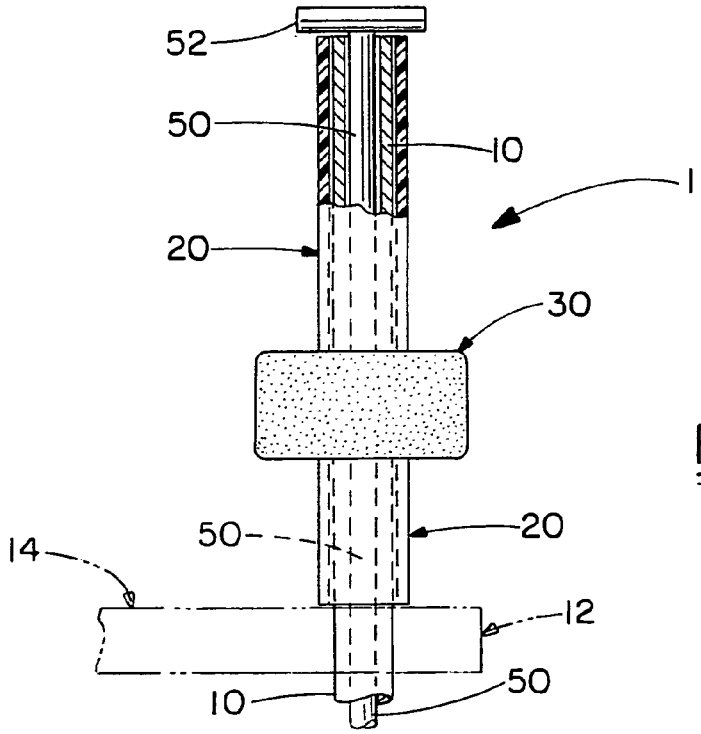
FIG. 4 is a side elevation view, in partial cross-section, of the floatable dock mooring article having an extension pipe.

Another embodiment of the present invention is shown in FIG. 4 which allows an even further rise in the height of dock mooring article 1. Mooring member 20 can be any of the various arrangements as shown in FIG. 1, 2, or 3. An extension pipe 50 generally having a hollow or solid cylindrical shape is inserted or resides inside dock pipe 10 which has an internal opening therein. The extension pipe can be made of the same types of materials as set forth above with respect to dock mooring member 20 such as lightweight metal, but preferably is plastic. The top of extension pipe 50 has flange 52 secured thereto and the same can be in the form of any shape such as a disk or a handle as shown in FIG. 4. However, extension pipe 50 is desirably longer than the length of mooring member 20 which resides on dock 12. That is, the extension pipe in being located within the dock pipe can extend several feet beneath the dock. Thus, as the water level rises and contacts float 30 and causes the same to raise, dock mooring member 20 will contact top flange 52 of the extension pipe and cause the extension pipe to rise. Even though the bottom end of dock mooring member 20 can rise above the top dock pipe 10, extension pipe 50 can still be located within the dock pipe, thereby maintaining a secure engagement of the watercraft.

In view of the above description, it should be apparent that floating dock mooring article 1 of the present invention is very versatile. For example, flotation device 30 can be located in any position along the length of dock mooring member 20 provided that a mooring line can be located either above or below the float. Multiple flotation devices can be utilized although a single float is generally preferred. The length of dock mooring member 20 can be long or short and optionally, can be utilized in association with extension pipe 50 to further extend the vertical range of usefulness of the dock mooring member. Moreover, couplings can be utilized to join one portion of mooring member 20 to another portion and/or to enlarge or reduce the diametrical size thereof.

What is claimed is:

1. A floatable dock mooring article, comprising:

a float attached to a portion of a mooring member so that an upper leg and a lower leg extend above and below said float, a flange located on the end portion of said upper leg, said upper leg and said lower leg capable of receiving a mooring device for a watercraft, said mooring member adapted to have an internal diameter greater than an outer diameter of a dock pipe, said mooring member adapted to be movably connected to a portion of said dock pipe, and said lower leg being capable of contacting and resting on a dock; including an extension pipe adapted to have an outside diameter less than the inside diameter of said dock pipe, said extension pipe capable of fitting inside said dock pine.

2. The floatable mooring article according to claim 1, wherein said mooring member comprises lightweight metal, wood, plastic, fiberglass, or a composite material, wherein said lower leg has a flange on the end portion thereof, and wherein said float comprises wood, plastic, foam, a composite material, an inflatable rubber, or an inflatable plastic.

3. The floatable dock mooring article according to claim 2, wherein said mooring member is plastic, and wherein said float is said foam or said inflatable material.

4. The floatable dock mooring article according to claim 3, wherein said mooring member plastic is polyvinyl chloride, wherein said foam float is derived from polyurethane or polystyrene, and wherein said float is attached to said mooring member by an adhesive.

5. The floatable dock mooring article according to claim 1, wherein said float is located at a height of from about 10% to about 90% of said dock mooring member height.

6. The floatable dock mooring article according to claim 3, wherein said float is located at a height of from about 20% to about 80% of said dock mooring member height.

7. A floatable dock mooring article, comprising:

a mooring member, said mooring member adapted to have an internal diameter greater than the outer diameter of a dock pipe and adapted to be moveably connected to a portion of said dock pipe, a float having an internal diameter larger than the external diameter of said mooring member, said float being freely movable about said dock mooring member, said dock mooring member having an upper flange which serves as a float stop, said dock mooring member capable of receiving a mooring device for a watercraft, and said dock mooring member being capable of contacting and resting on a dock.

8. A floatable mooring article according to claim 7, wherein said mooring member comprises lightweight metal, wood, plastic, fiberglass, or a composite material, and wherein said float comprises wood, plastic, foam, a composite material, or an inflatable material.

9. A floatable mooring article according to claim 8, wherein said mooring member is plastic, wherein said float is a foam or said inflatable material, and including a flange located on the bottom of said mooring member.

10. A floatable mooring article according to claim 9, wherein said mooring member plastic is polyvinyl chloride, and wherein said foam float is derived from polyurethane or polystyrene.

11. A floatable mooring article according to claim 10, including an extension pipe having an outside diameter less than the inside diameter of said dock pipe, said extension pipe residing inside said dock pipe.

12. A floatable mooring article according to claim 8, including an extension pipe having an outside diameter less than the inside diameter of said dock pipe, said extension pipe residing inside said dock pipe.

13. A floatable mooring article according to claim 7, including an extension pipe having an outside diameter less than the inside diameter of said dock pipe, said extension pipe residing inside said dock pipe.

* * * * *